US005931484A

United States Patent [19]

Jones et al.

[11] Patent Number: 5,931,484

[45] Date of Patent: Aug. 3, 1999

[54] BALING WIRE CART

[75] Inventors: Samuel E. Jones; Gerald L. Johnson, both of Carthage, Mo.

[73] Assignee: L&P Property Management Company, South Gate, Calif.

[21] Appl. No.: 08/858,651

[22] Filed: May 19, 1997

[51] Int. Cl.[6] ..... B62B 1/14

[52] U.S. Cl. ..... 280/47.24; 280/79.3

[58] Field of Search ..... 280/47.17, 47.19, 280/47.28, 47.24, 79.3, 79.4; 242/557, 566, 563.2, 571, 563, 529; 83/522.11, 522.19

[56] References Cited

U.S. PATENT DOCUMENTS

| | | | |
|---|---|---|---|
| 191,153 | 5/1877 | Johnson | 242/563 |
| 212,426 | 2/1879 | Baron | 242/563 |
| 612,000 | 10/1898 | Jenkins | 242/563 |
| 649,444 | 5/1900 | Good | 403/322 |
| 875,476 | 12/1907 | Wasson | 242/557 |
| 2,134,195 | 10/1938 | Martin | 242/566 |
| 2,155,769 | 4/1939 | Porter . | |
| 2,155,771 | 4/1939 | Porter . | |
| 2,229,787 | 1/1941 | Abbott . | |
| 3,050,273 | 8/1962 | Saunders . | |
| 3,224,705 | 12/1965 | Nash . | |
| 3,282,304 | 11/1966 | Coleman | 242/566 |
| 3,937,414 | 2/1976 | Bank et al. | 280/47.19 |
| 4,143,826 | 3/1979 | Lamperti . | |
| 4,564,152 | 1/1986 | Herriage | 280/47.19 |
| 4,949,909 | 8/1990 | Hatfield | 242/557 |
| 5,042,737 | 8/1991 | Sigle et al. | 242/557 |
| 5,100,077 | 3/1992 | Gagné et al. | 242/566 |
| 5,123,666 | 6/1992 | Moore | 280/47.28 |
| 5,158,243 | 10/1992 | Sigle et al. | 242/557 |
| 5,473,923 | 12/1995 | Hochspach et al. . | |
| 5,509,671 | 4/1996 | Campbell . | |
| 5,577,745 | 11/1996 | Birk . | |
| 5,595,355 | 1/1997 | Haines . | |

*Primary Examiner*—J. J. Swann
*Assistant Examiner*—Frank Vanaman
*Attorney, Agent, or Firm*—Wood, Herron & Evans, L.L.P.

[57] ABSTRACT

A hand cart for transporting a roll of wire and straightening and measuring a length of wire pulled from the roll. The hand cart comprises a generally planar frame having upper and lower transverse mounting plates located in the plane of the frame. A center post extends outwardly from the lower transverse mounting plate and rotatably supports a rotatable reel. The rotatable reel is adapted to support a roll of wire for rotation about a reel axis, the reel axis being generally perpendicular to the plane of the frame. The hand cart further comprises a transverse axle and a pair of rotatable wheels rotatable mounted on opposite ends of the axle. A wire straightener and a wire counter are secured to the upper mounting plate of the frame so that a length of wire pulled off the roll may be straightened and measured before it is cut to the appropriate length.

25 Claims, 2 Drawing Sheets

BALING WIRE CART

FIELD OF INVENTION

This invention relates to a hand cart or dolly for transporting a roll of baling wire and more particularly to a baling wire cart which has a wire straightener and a counter affixed to the cart for straightening and measuring a length of wire which may be pulled off the roll.

BACKGROUND OF THE INVENTION

Materials such as cardboard are often compressed and baled before being shipped to their destination, for example a recycling facility. Once compressed, the bale of material is bound with baling wire in order to maintain compression of the material. In order to bind certain size bales of material, it is desirable to have a pre-determined length of baling wire already cut so that the baling wire may simply be wrapped around the material to be baled and tied with an appropriate tying instrument.

Often such compressed bales of material are located a distance from one another on the floor of a warehouse or other facility. Rather than cutting lengths of bailing wire unwound from a roll or coil of baling wire located at one central location and carrying long lengths of baling wire to different bales at different locations, it is more convenient to wheel a hand cart or dolly capable of holding a roll of baling wire from one location to another where the material to be baled is located.

Hand carts or dollys have been known to be adapted to support rolls or coils of wire so that a user may draw the wire off the roll or coil by simply pulling on the free end of the wire or strapping. U.S. Pat. No. 2,229,787 discloses a wheeled holder for a coil of wire comprising a vertical tube having a handle at the top thereof and a generally horizontal main tube having a pillar extending upwardly therefrom about which a rotatable coil support is rotatably mounted. Two wheels at the front of the main tube enable the cart to be picked up and rolled from location to location.

The device further has a guide which enables wire to be drawn off the coil and directed upwardly by the user. One difficulty with such a cart designed to hold a horizontally oriented coil of wire is that the cart is bulky and difficult to lift and transport. Further, the wire may tend to twist as it is drawn off the coil, through the guide tube and cut resulting in pieces of baling wire which are curved and twisted rather than straight.

One patent which discloses such a straightening device at the end of a coil unwinder is U.S. Pat. No. 4,134,826. This patent discloses a plurality of guides located around the periphery of a coil of wound wire which is supported on a rotatable circular plate.

The wire is passed through the guides before passing through a plurality of rollers which function as a straightening device as the free end of the wire is pulled off the coil. This device may be moved from location to location by pulling downwardly on a handle to lower a wheeled platform so as to make the coil unwinding apparatus mobile. One difficulty with this coil unwinding apparatus is that the apparatus is bulky and difficult to move from location to location because it houses a motor and transmission unit. Further, the device has a wire straightening mechanism for straightening wire being pulled off the roll of wire but has no device for measuring the length pulled off the coil unwinder.

U.S. Pat. Nos. 5,509,671 and 5,577,745 disclose hand dollys or carts adapted to carry multiple spools of wire.

However, both of these hand carts are adapted to receive and hold one or more removable supports upon which the reels of wire are rotatably supported. When a reel of wire is exhausted of wire, a portion of the removable support must be removed in order for a new reel of wire to be placed on the support. This process is time consuming and requires substantiated physical effort to remove the releasable support from the hand cart. Further, each of these hand carts or dollys is lacking any means to straighten the wire once it is removed from the reel or means to measure a length of wire as it is removed from a reel.

A need therefore exists for a relatively simple and inexpensive hand cart or dolly adapted to rotatably support a roll of wire mounted on a rotatable support, the rotatable support being adapted to easily and quickly receive a new roll of wire once the existing roll has been exhausted. A need also exists for such a hand cart or dolly which is capable of straightening and measuring a length of wire which may be pulled off a rotatable roll of wire rotatably supported on the hand cart.

Therefore, it has been one objective of the present invention to provide a relatively inexpensive hand cart which is capable of rotatably supporting a roll of wire and has convenient and easily usable means to straighten and measure a length of wire pulled off the roll.

It has been a further objective of the present invention to provide a hand cart adapted to rotatably support a roll of wire upon a rotatable reel, the rotatable reel being capable of receiving a new roll of wire without the reel being removed from the cart frame.

It has been a further objective of the present invention to provide a hand cart capable of transporting a roll of wire having a free end which may be easily and conveniently be pulled off the roll, passed through a feed tube, straightened and measured before being cut to a desired length.

SUMMARY OF THE INVENTION

The invention of the application which accomplishes these objectives comprises a two wheel hand cart or dolly capable of transporting a roll of wire, and straightening and measuring a length of wire pulled off the roll. The hand cart comprises a frame, a transverse axle secured to the frame, a pair of wheels rotatably mounted on the axle, a rotatable reel supporting a roll of wire, a feed tube, a wire straightener and a wire counter. The pair of wheels are rotatably mounted on the axle secured to the lower portion of the generally planar frame and enable the hand cart to be easily moved from location to location by tilting the cart frame rearwardly so that the weight of the cart is supported by the wheels. The hand cart may further comprise a base plate secured to the lower portion of the frame for supporting the cart in a vertical attitude.

The frame of the hand cart is generally planar comprising two generally parallel side rails joined together at the top of the frame with a U-shaped handle portion. This portion of the frame acts as the handle for the user when wheeling the frame from one desired location to another. A middle rail extends between the side rails generally parallel the side rails and provides additional stability to the frame. A lower transverse mounting plate extends generally between the side rails in the plane of the frame. A center post is permanently secured to the lower transverse mounting plate and extends outwardly from the lower mounting plate in a direction generally perpendicular to the plane of the frame. The center post defines an axis about which the rotatable reel rotates. An upper transverse mounting plate also extends between the side rails and is located generally in the plane of the frame. The wire straightener and wire counter are fixedly secured to this upper transverse mounting plate.

The rotatable reel is rotatably mounted on the center post. The reel comprises an inner hub which is adapted to slidably mount on the center post. Four inner spokes extend outwardly from the inner hub and are of a length greater than the outer diameter of the roll of wire before the wire is unwound from the roll. The rotatable reel further comprises four outer spokes which extend outwardly from an outer hub. The inner and outer spokes are aligned with each other with a support bar extending between each inner spoke and its corresponding outer spoke in a direction generally perpendicular to the plane of the frame.

Each of the outer spokes comprises a hollow portion and an extension bar slidably receivable within the hollow portion in order to change the effective length of each of the outer spokes. This change in the effective length of the outer spokes enables a roll of wire to be quickly and easily placed on the reel. The hollow portion of each outer spoke has a straight groove or slot therein with a U-shaped indentation at one end of the groove. A spring located within the hollow portion of the outer spoke functions to bias the extension bar outwardly. A pin secured to each extension bar and extends through and is slidable within the groove.

To place a new roll of wire on the reel, either the extension bars or pins may be pushed inwardly toward the outer hub, compressing the springs located within the hollow portion of each outer spoke and moving the pins attached to the extension bars inwardly. At the innermost position of the extension bars, the bars and pins are rotated to lock the extension bars in their innermost positions. A new roll of wire may then be placed over the foreshortened outer spokes and onto the inner spokes of the reel. Once a new roll of wire is placed on the inner spokes of the reel, the pins of the extension bars may be released from their locked position in the U-shaped indentation portion of the slots or grooves of the outer spokes by rotation of the extension bars, thereby permitting the extension bars to be moved outwardly to their extended positions in which the extension bars extend over the roll of wire on the reel and secure the roll of wire on the rotatable reel.

The hand cart further comprises a feed tube fixedly secured to the frame and located in a plane, generally tangential to the roll of wire.

In addition to the feed tube, a wire straightener is secured to the upper portion of the frame and comprises a plurality of rollers. A screw or other means may be used to adjust the distance between adjacent rollers so as to increase or decrease the straightening ability of the wire straightener.

The hand cart of the present invention lastly comprises a wire counter secured to the upper transverse mounting plate of the frame. The wire counter is capable of measuring a length of wire pulled off the roll and through the wire counter. The wire counter has a digital display in order to inform the user how much wire he or she has pulled off the roll of wire. Once the user has pulled off the desired amount of wire, as determined by the wire counter, the user cuts off the wire to the desired length either manually or by a cutter affixed to the frame of the cart. Thus, the cart of the present invention is able to easily and conveniently receive a roll of wire, transport the roll of wire from one location to another without a great deal of effort, straighten the wire as it is pulled tangentially off a rotatable reel supporting the roll of wire and measure the amount of wire pulled off the roll. With such a device, a user can pull off multiple pieces of wire of the same length to be used for baling or other purposes.

These and other objects and advantages of this invention will be apparent from the following description of the drawings.

DETAILED DESCRIPTION OF THE DRAWINGS

Figure 1:
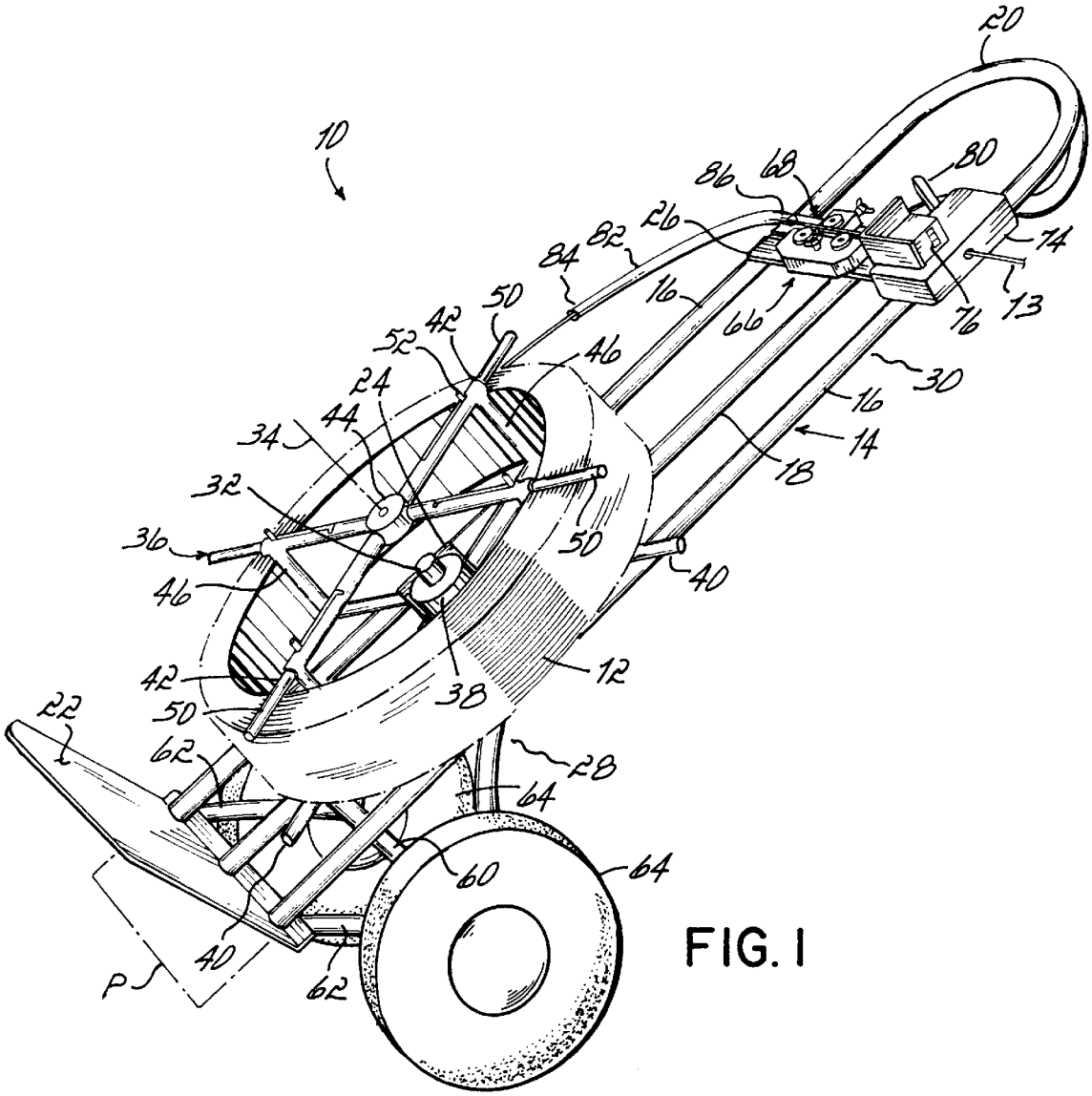
FIG. 1 is a perspective view of the hand cart of the present invention.

Referring to the drawings and particularly to FIG. 1, there is illustrated a wheeled hand cart or dolly 10 which is capable of transporting a roll of wire 12, straightening and measuring a length of wire pulled off of the roll 12. The hand cart 10 comprises a generally planar frame 14 which defines and is located in a plane P. The frame 14 comprises two generally parallel side rails 16 and a middle rail 18, the middle rail 18 being generally parallel the side rails 16 and all of the rails being located in the plane P. Each of the side rails 16 extends upwardly to a handle portion 20 which is generally in the shape of an inverted U. The handle portion 20 is grasped by the user and pulled rearwardly in order to incline the hand cart and wheel the hand cart from one location to another. The lower portion of each rail is secured to a base plate 22 which extends generally perpendicular to the plane P of the frame and may function to lift and transport items other than the roll of wire 12. FIG. 1 illustrates a hand cart of the present invention having a base plate. Further, a lower transverse mounting plate 24 is fixedly secured to the side rails 16 of the frame 14 and extends between opposing side rails at a lower portion 28 of the frame. Similarly, an upper transverse mounting plate 26 is located in the plane P of the frame and is fixedly secured to the frame at the upper portion 30 of the frame proximate the handle portion 20. Like the lower transverse mounting plate, the upper transverse mounting plate 26 extends from one side rail 16 to the other.

A center post 32 is fixedly secured to the lower transverse mounting plate 24 and extends generally perpendicular to the plane P of the frame. The center post 32 defines a reel axis 34 about which a rotatable reel 36 rotates.

The rotatable reel 36 comprises an inner hub 38 having a hole centrally located therein into which the center post 32 is inserted. Extending outwardly from the inner hub 38 are four inner spokes 40, each inner spoke 40 being of a length greater than the outer diameter of the roll of wire 12 in order to prevent the roll of wire 12 from falling off the rotatable reel 36. The rotatable reel 36 further comprises four outer spokes 42 extending outwardly from an outer hub 44. The outer spokes 42 are aligned with the inner spokes 40 and each inner spoke 40 is connected to an outer spoke 42 by a support bar 46. The roll of wire 12 rests generally on the four support bars 46. Each inner and outer spoke is approximately 90° offset from adjacent spokes in order to provide a stable reel for supporting a roll of wire. Although four inner spokes 40 and four outer spokes 42 are disclosed, any number of spokes may be utilized in accordance with the present invention.

Figure 2:
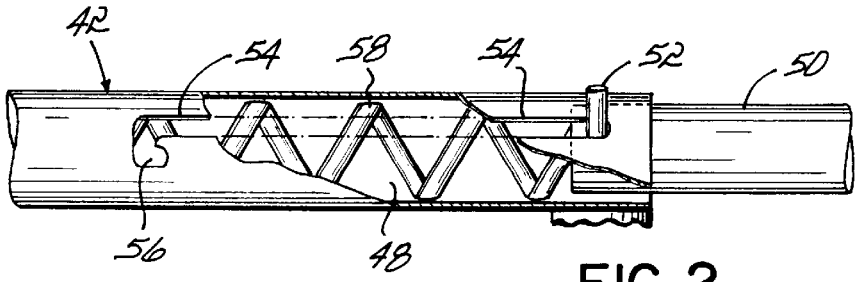
FIG. 2 is an enlarged partially broken away elevational view of one of the outer spokes of the rotatable reel of the hand cart of FIG. 1.

The effective length of each outer spoke 42 is adjustable in order to enable an operator to place a new roll of wire 12 onto the rotatable reel 36 once the previous roll of wire has been exhausted. Each outer spoke 42 comprises a hollow portion 48 and an extension bar 50 slidably receivable within the hollow portion 48. A pin 52 is permanently secured to one end of the extension bar 50 and slidably movable within a groove 54 cut in the hollow portion 48 of each outer spoke 42. Each groove 54 has an generally U-shaped indentation 56 at one end of the groove 54 which functions to lockingly secure the pin 52 of the extension bar 50. A spring 58 is seated inside the hollow portion 48 of each outer spoke 42 and functions to bias the extension bar 50 outwardly. When a user desires to place a new roll of wire 12 on the rotatable reel 36, the user may push either the pin 52 or the extension bar 50 radially inwardly causing the pin 52 to move radially inwardly along the groove 54 in the hollow portion 48 of each outer spoke toward the outer hub 44 until the pin 52 rests in the indentation 56 thereby locking the extension bar in a locked position inside the hollow portion 48 of the outer spoke 42 and shortening the effective length of the outer spoke. The inner diameter of the roll of wire 12 is greater than the sum of the lengths of the hollow portions 48 of two opposed outer spokes 42 enabling a new roll of wire 12 to be passed over the hollow portions 48 of the outer spokes 42 and placed on the rotatable reel 36 when the extension bars 50 are locked in a withdrawn position with pins 52 locked in indentations 56. Once a new roll of wire 12 is placed on the rotatable reel 36 and rested against inner spokes 40, the pins 52 of the extension bars 50 are removed from the indentations 56 and allowed to slide outwardly by means of the bias of the springs 58 until they come to rest in the position illustrated in FIG. 2 with the extension bars 50 pushed radially outwardly thereby increasing the effective length of the outer spokes 42 such that the outer spokes 42 are greater in length than the outer diameter of a new roll of wire. With the extension bars 50 so extended, the effective length of each outer spoke 42 is great enough so that the roll of wire 12 will not come off the rotatable reel 36 even if the frame 14 is oriented vertically or even tipped over completely.

The wheeled hand cart of the present invention further comprises a transverse axle 60 secured to the frame 14 by four support braces 62, two of the support braces 62 being secured to each side rail 16 of the frame 14. A pair of rotatable wheels 64 are rotatably mounted on opposite ends of the transverse axle 60. When the frame 14 is pulled backwardly by a user, the entire weight of the hand cart which may include the full weight of a reel of wire, is supported by the wheels 64.

Figure 3:
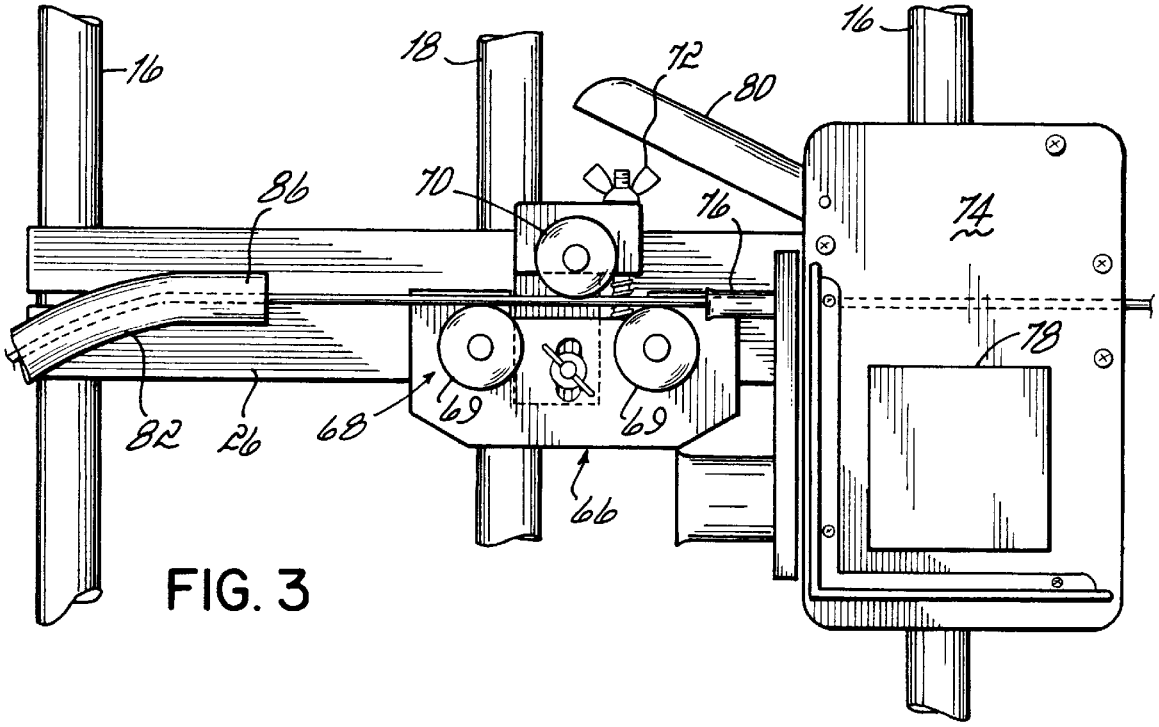
FIG. 3 is an enlarged front elevational view of the wire straightener and wire counter mounted to the frame of the hand cart of FIG. 1.

As best illustrated in FIG. 3, a wire straightener 66 is mounted to the upper transverse mounting plate 26. The wire straightener 66 comprises a plurality of rollers 68 offset from one another. The embodiment illustrated in FIG. 3 illustrates three rollers, two lower rollers 69 being located underneath a middle roller 70. However, any number of rollers may be used in accordance with the present invention. The height of the middle roller 70 is adjusted by an adjusting means 72 which may be a screw or other device.

Located adjacent wire straightener 66 is a wire counter 74 which is capable of measuring a length of wire passing through the counter. Any counter capable of measuring a length of wire may be used and the invention of the present application is not intended to limit the counter to any one make or model. One counter which may be used in accordance with the present invention is a counter manufactured by Olympic Instruments Incorporated of Vashon, Wash. and identified as that company's model number 1410. The counter 74 has an inlet tube 76 and a display 78 in order to show the user what length of wire has passed through the counter. A lever 80 on counter 74, when pushed downwardly, facilitates initial pulling or starting of wire through the counter.

The hand cart of the present invention also comprises a feed tube 82 which is also secured to the frame 14. The feed tube 82 has an inlet 84 and an outlet 86, the outlet 86 being proximate the wire straightener 66. The feed tube 82 is generally hollow having an inner diameter greater than the outer diameter of the wire enabling the wire to pass upwardly through the feed tube 82 to the wire straightener 66.

In use, once a roll of wire 12 is placed on the rotatable reel 36, the free end of the wire 13 is tangentially pulled upwardly through the feed tube 82, through the wire straightener 66 and through the counter 74. It is then further pulled off the roll 12 to the desired length at which point it is cut either manually or by some sort of mechanism secured to the frame of the hand cart. Thus, with the hand cart of the present invention, multiple pieces of straight baling wire of identical length may be pulled off a rotatable roll of wire in order to be used to bale material. The roll of wire need not be carried from one location to another, but may simply be inserted quickly and easily on the hand cart of the present invention and rolled to the desired location where a desired number of straight pieces may be cut to an identical length.

It will be understood and appreciated by those skilled in the art that various changes and modifications to this hand cart may be made without departing from the spirit and scop of the invention. Therefore, we do not intend to be limited except by the following claims.

We claim:

1. A hand cart for transporting a roll of wire to a desired location, straightening and measuring a length of wire pulled from said roll, said hand cart comprising:

a generally planar frame located generally in a first plane, said frame having a fixed transverse mounting plate located in said first plane, a center post extending outwardly from said transverse mounting plate and located generally perpendicular to said first plane, a transverse axle and a pair of rotatable wheels rotatably mounted on opposite ends of said axle, said axle being secured to said frame, a rotatable reel rotatably mounted on said center post, said rotatable reel being adapted to support a roll of wire for rotation about an axis, said axis being generally perpendicular said first plane, said rotatable reel comprising an inner support and a plurality of outer spokes extending outwardly from an outer hub, said outer spokes having adjustable lengths to enable rolls of wire to be placed over said outer spokes and onto said rotatable reel when said outer spokes are adjusted to a shortened length and to be retained on said rotatable reel when said outer spokes are lengthened, a wire straightener secured to said frame for straightening said length of wire as it is removed from said roll, and a wire counter secured to said frame, said counter being operable to measure the length of wire passing through said counter as it is removed from said roll.

2. The hand cart of claim 1 further comprising a hollow feed tube secured to said frame, said feed tube having an inlet end and an outlet end.

3. The hand cart of claim 1 wherein said inner support comprises a plurality of inner spokes secured to said inner hub, each inner spoke being secured to an outer spoke with a support bar.

4. The hand cart of claim 1 wherein each of said outer spokes comprises a hollow portion and an extension bar slidably receivable within said hollow portion in order to adjust the length of said outer spoke.

5. The hand cart of claim 4 wherein a spring biases said extension bar radially outwardly.

6. The hand cart of claim 1 further comprising a base plate secured to said frame, said base plate extending perpendicular said first plane and outwardly from said first plane so that items may be lifted and transported by said base plate.

7. The hand cart of claim 1 wherein said frame has an inverted U shaped handle portion.

8. The hand cart of claim 1 wherein said wire straightener comprises at least one roller.

9. A hand cart for transporting a roll of wire to a desired location and for dispensing, straightening, measuring and cutting a length of wire pulled from said roll at said desired location, said hand cart comprising:

a generally planar frame defining a first plane, said frame having a fixed lower transverse mounting plate located generally in said first plane, a center post secured to said lower mounting plate and extending generally perpendicular to said first plane, a pair of rotatable wheels rotatably mounted on an axle, said axle being secured to said frame, a rotatable reel rotatably mounted on said center post, said rotatable reel being adapted to support a roll of wire and being rotatable about an axis, said axis being generally perpendicular said first plane, said rotatable reel comprising a plurality of inner spokes extending outwardly from an inner hub and a plurality of outer spokes extending outwardly from an outer hub, said inner and outer hubs being aligned with said axis, each of said outer spokes having an adjustable length, a fixed upper mounting plate secured to said frame, a wire straightener secured to said upper mounting plate, a wire counter secured to said upper mounting plate, said wire counter being operable to measure a length of wire passing through said wire counter after said length of wire has passed through said wire straightener whereby said hand cart and said roll of wire may be transported on said wheels to said desired location where multiple pieces of wire of a predetermined length may be pulled from the rotatable roll of wire, straightened, measured and cut.

10. The hand cart of claim 9 further comprising a feed tube secured to said frame in order to guide said length of wire into said wire straightener.

11. The hand cart of claim 9 wherein said wire straightener comprises a plurality of rollers.

12. The hand cart of claim 9 wherein each of said outer spokes comprises a hollow portion and an extension bar slidably receivable with said hollow portion in order to adjust the length of said outer spokes.

13. The hand cart of claim 9 wherein said rotatable reel has four outer spokes and four inner spokes.

14. The hand cart of claim 9 further comprising a base plate secured to said frame, said base plate extending perpendicular said first plane.

15. The hand cart of claim 9 wherein said frame has an arcuate handle portion integrally formed in said frame.

16. A hand cart for transporting a roll of wire to a desired location and for dispensing, straightening, measuring and cutting a length of wire pulled from said roll at said desired location, said hand cart comprising:

a generally planar frame defining a first plane, said frame comprising two side rails connected to each other with an arcuate handle portion and a transverse mounting plate extending between said side rails, a center post extending outwardly from said mounting plate generally perpendicular to said first plane, an axle secured to said frame and a pair of rotatable wheels rotatably mounted on said axle, a rotatable reel rotatably mounted on said center post, said rotatable reel adapted to support a roll of wire for rotation about a reel axis, said reel axis being generally perpendicular to said first plane, said rotatable reel comprising an inner support and a plurality of outer spokes secured to an outer hub, at least one of said outer spokes having an adjustable length, a wire straightener secured to said frame, a wire counter secured to said frame capable of measuring a length of wire passing through said wire counter whereby said hand cart and said roll of wire may be transported to said desired location where multiple pieces of wire of a predetermined length may be pulled from the rotatable roll of wire, straightened, measured and cut.

17. The hand cart of claim 16 further comprising a hollow feed tube secured to said frame, said feed tube having an outlet located proximate said wire straightener.

18. The hand cart of claim 16 wherein said inner support comprises a plurality of inner spokes secured to an inner hub.

19. The hand cart of claim 18 wherein each of said outer spokes comprises a hollow portion and an extension bar slidably receivable within said hollow portion in order to adjust the length of said outer spokes.

20. The hand cart of claim 19 further comprising means to bias said extension bar radially outwardly.

21. The hand cart of claim 16 further comprising a base lift plate secured to said frame.

22. The hand cart of claim 16 wherein said wire straightener comprises adjustable rollers.

23. A hand cart for transporting a roll of wire, said hand cart comprising:

a generally planar frame located generally in a first plane, said frame having a transverse mounting plate located in said first plane, a center post extending outwardly from said transverse mounting plate and located generally perpendicular to said first plane, a rotatable reel rotatably mounted on said center post, said rotatable reel being adapted to support a roll of wire for rotation about an axis, said axis being generally perpendicular said first plane, said rotatable reel comprising an inner support and a plurality of outer spokes extending outwardly from a central hub, said outer spokes having adjustable lengths to enable rolls of wire to be placed over said outer spokes and onto said inner support of said rotatable reel when said outer spokes are adjusted to a shortened length, said rolls of wire being retained on said rotatable reel when said outer spokes are lengthened; and support means secured to said frame for rotatably supporting said frame.

24. The hand cart of claim 23 further comprising a wire straightener and a wire counter secured to said frame so that a length of wire may be pulled from said roll of wire, straightened and measured before being cut at any desired location.

25. The hand cart of claim 23 wherein said support means is a transverse axle and a pair of rotatable wheels rotatably mounted on opposite ends of said axle.

* * * * *